US007448878B2

(12) United States Patent
Saito et al.

(10) Patent No.: US 7,448,878 B2
(45) Date of Patent: Nov. 11, 2008

(54) INTERVENING CONNECTION APPARATUS CAPABLE OF EASILY AND ACCURATELY POSITIONING A CONDUCTOR

(75) Inventors: Kazuki Saito, Tokyo (JP); Masami Kitayama, Tokyo (JP); Seiya Matsuo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/985,915

(22) Filed: Nov. 19, 2007

(65) Prior Publication Data

US 2008/0076275 A1 Mar. 27, 2008

Related U.S. Application Data

(62) Division of application No. 11/540,439, filed on Sep. 29, 2006, now Pat. No. 7,329,130.

(30) Foreign Application Priority Data

Sep. 30, 2005 (JP) ..... 2005-286806
Nov. 30, 2005 (JP) ..... 2005-344818
Jan. 6, 2006 (JP) ..... 2006-001249

(51) Int. Cl.
*H01R 12/00* (2006.01)

(52) U.S. Cl. ..... 439/66; 439/91; 439/591

(58) Field of Classification Search ..... 439/91, 439/66, 591
See application file for complete search history.

(56) References Cited

U.S. PATENT DOCUMENTS 4,421,370 A 12/1983 Treakle et al.
5,259,770 A 11/1993 Bates et al.
5,336,094 A 8/1994 Johnson
6,224,394 B1 5/2001 Matsumoto

FOREIGN PATENT DOCUMENTS

| | | |
|---|---|---|
| JP | 59-159880 | 10/1984 |
| JP | 01-164679 | 11/1989 |
| JP | 03-126367 | 5/1991 |
| JP | 04-066780 | 6/1992 |
| JP | 09-251880 | 9/1997 |
| JP | 11-307212 | 11/1999 |
| JP | 2000-048877 | 2/2000 |

(Continued)

OTHER PUBLICATIONS

Japanese Office Action dated May 14, 2008 in Japanese Application No. 2005-286806 (Attachment A).

(Continued)

*Primary Examiner*—Briggitte R Hammond
(74) *Attorney, Agent, or Firm*—Collard & Roe, P.C.

(57) ABSTRACT

In a connection apparatus for electrically connecting two connection objects to each other, a frame is disposed between the connection objects and has two surfaces faced to the connection objects, respectively. An elastic member penetrates the frame and has two end portions protruding from the two surfaces, respectively. A conductor is coupled with the elastic member and extending between the two end portions. A positioning member is formed as a member separate from the elastic member and positioning the elastic member with respect to the frame.

5 Claims, 11 Drawing Sheets

FOREIGN PATENT DOCUMENTS

| | | |
|---|---|---|
| JP | 2002-008810 | 1/2002 |
| JP | 2003-185700 | 7/2003 |
| JP | 2003-282168 | 10/2003 |
| JP | 2005-038759 | 2/2005 |
| JP | 2005-228504 | 8/2005 |
| JP | 2005-251420 | 9/2005 |

OTHER PUBLICATIONS

Japanese Office Action dated May 14, 2008 in Japanese Application No. 2005-344818 (Attachment B) (With English Translation).
Japanese Office Action dated May 14, 2008 in Japanese Application No. 2006-001249 (Attachment C).

INTERVENING CONNECTION APPARATUS CAPABLE OF EASILY AND ACCURATELY POSITIONING A CONDUCTOR

This is a divisional of application Ser. No. 11/540,439, filed on Sep. 29, 2006 now U.S. Pat. No. 7,329,130.

This application claims priority to prior Japanese patent application JP 2005-286806, 2005-344818 and 2006-1249, the disclosures of which are incorporated herein by reference.

BACKGROUND OF THE INVENTION

This invention relates to a connection apparatus intervening between two connection objects to electrically connect the connection objects to each other. The connection apparatus of the type may hereinafter be called an "intervening connection apparatus".

A connection apparatus of the type is disclosed in Japanese Unexamined Patent Application Publication (JP-A) No. 2005-228504 and comprises a frame and a terminal portion fixed to the frame. The frame is produced from an insulating material and has a receiving hole penetrating the frame between opposite surfaces thereof. The terminal portion comprises an insulating elastic member having flexibility and a plurality of conductors formed on a surface of the insulating elastic member. The elastic member is received in the receiving hole of the frame to penetrate therethrough so that the conductors protrude from the opposite surfaces of the frame. The elastic member is prevented from being released from the frame by tapes adhered to the opposite surfaces of the frame, respectively. Thus, the elastic member is fixed to the frame. The connection apparatus is interposed between two connection objects in contact therewith. At this time, contact points of the connection objects are faced to the conductors of the connection apparatus. As a consequence, the connection objects are electrically connected to each other through the conductors of the connection apparatus.

The above-mentioned connection apparatus has various advantages, such as easy assembling, and is therefore desired to be improved further. For example, in view of high-density arrangement of the contact points of the connection objects, positioning of the conductors with respect to the frame is very important.

SUMMARY OF THE INVENTION

It is therefore an object of this invention to provide an intervening connection apparatus capable of easily and accurately positioning a conductor with respect to a frame.

It is another object of this invention to provide an intervening connection apparatus capable of positioning a conductor by engaging a member strengthening an elastic member with a frame.

It is still another object of this invention to provide an intervening connection apparatus capable of supporting an elastic member having a conductor by cooperation between a specific part of a frame and a member fixed to the frame.

It is yet another object of this invention to provide an intervening connection apparatus capable of positioning an elastic member having a conductor and a frame by convexo-concave engagement.

Other objects of the present invention will become clear as the description proceeds.

According to a basic aspect of the present invention, there is provided a connection apparatus for electrically connecting two connection objects to each other, the connection apparatus comprising a frame disposed between the connection objects and having two surfaces faced to the connection objects, respectively, an elastic member penetrating the frame and having two end portions protruding from the two surfaces, respectively, a conductor coupled with the elastic member and extending between the two end portions, and a positioning member formed as a member separate from the elastic member and positioning the elastic member with respect to the frame.

According to a first aspect of the present invention, there is provided a connection apparatus for electrically connecting two connection objects to each other, the connection apparatus comprising a frame disposed between the connection objects and having two surfaces faced to the connection objects, respectively, an elastic member penetrating the frame and having two end portions protruding from the two surfaces, respectively, a conductor coupled with the elastic member and extending between the two end portions, and a positioning member formed as a member separate from the elastic member and positioning the elastic member with respect to the frame, the positioning member including a stiffener member disposed inside the elastic member, the stiffener member having a protruding portion protruding from the elastic member and engaged with the frame.

According to a second aspect of the present invention, there is provided a connection apparatus for electrically connecting two connection objects to each other, the connection apparatus comprising a frame disposed between the connection objects and having two surfaces faced to the connection objects, respectively, an elastic member penetrating the frame in a predetermined direction and having two end portions protruding from the two surfaces, respectively, a conductor coupled with the elastic member and extending between the two end portions, and a positioning member formed as a member separate from the elastic member and positioning the elastic member with respect to the frame, the positioning member being fixed to the frame and supporting the elastic member in the predetermined direction.

According to a third aspect of the present invention, there is provided a connection apparatus for electrically connecting two connection objects to each other, the connection apparatus comprising a frame disposed between the connection objects and having two surfaces faced to the connection objects, respectively, an elastic member penetrating the frame and having two end portions protruding from the two surfaces, respectively, a conductor coupled with the elastic member and extending between the two end portions, and a positioning member formed as a member separate from the elastic member and positioning the elastic member with respect to the frame, the positioning member being integrally formed with the frame and extending in a first direction parallel to the surfaces, the positioning member having a protrusion protruding in a second direction parallel to the surfaces and perpendicular to the first direction, the elastic member having a recess engaged with the protrusion and positioned by the positioning member in the first direction.

DESCRIPTION OF THE PREFERRED EMBODIMENTS

Figure 1:
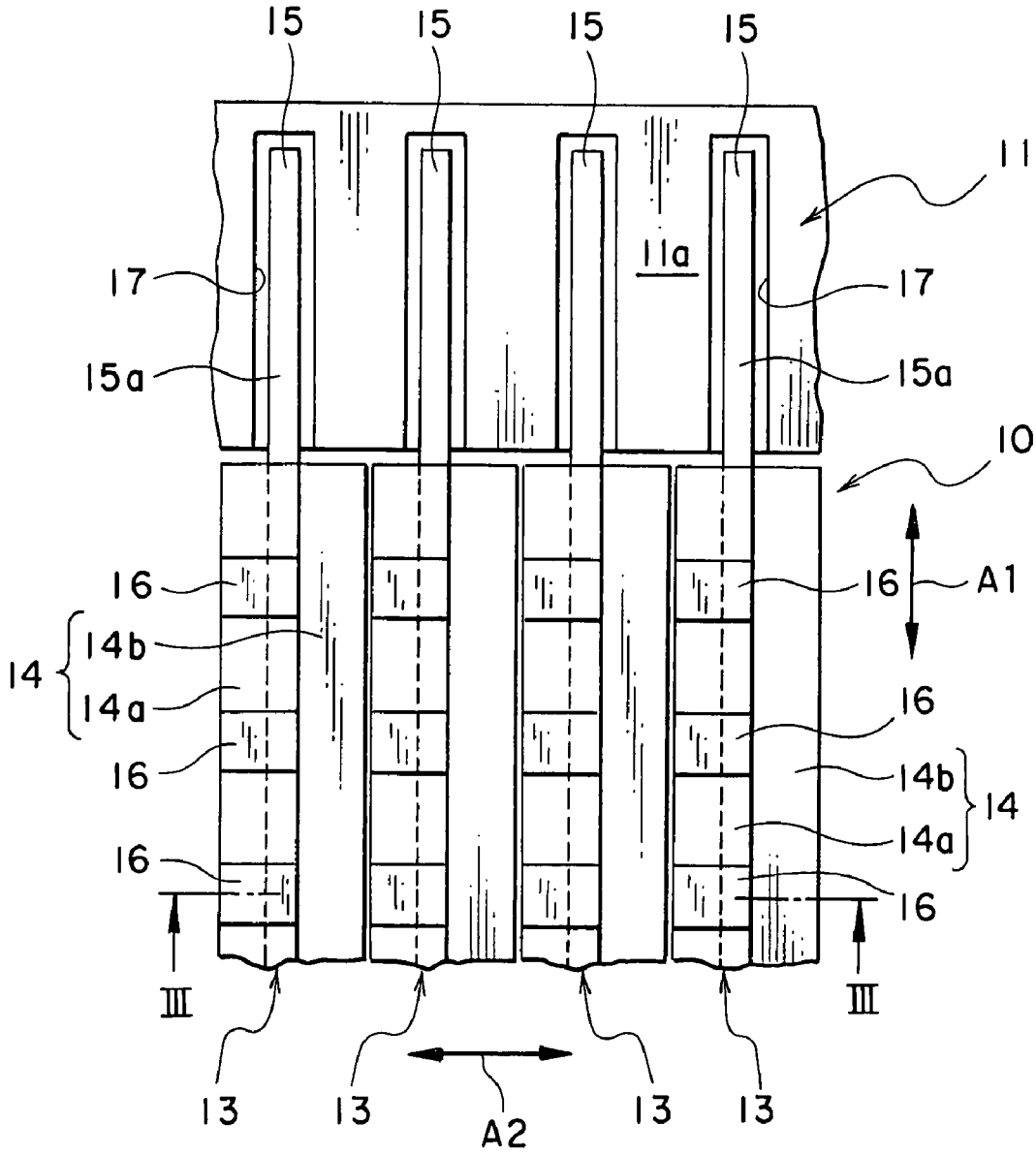
FIG. 1 is a plan view showing a characteristic part of a connection apparatus according to a first embodiment of this invention.
Figure 2:
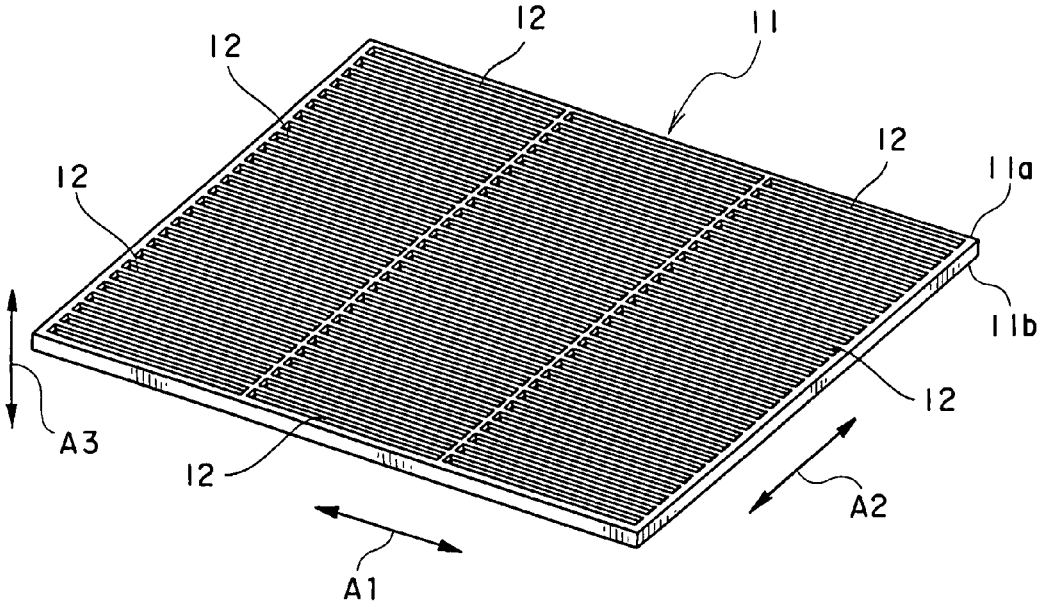
FIG. 2 is a perspective view of a frame used in the connection apparatus illustrated in FIG. 1.
Figure 3:
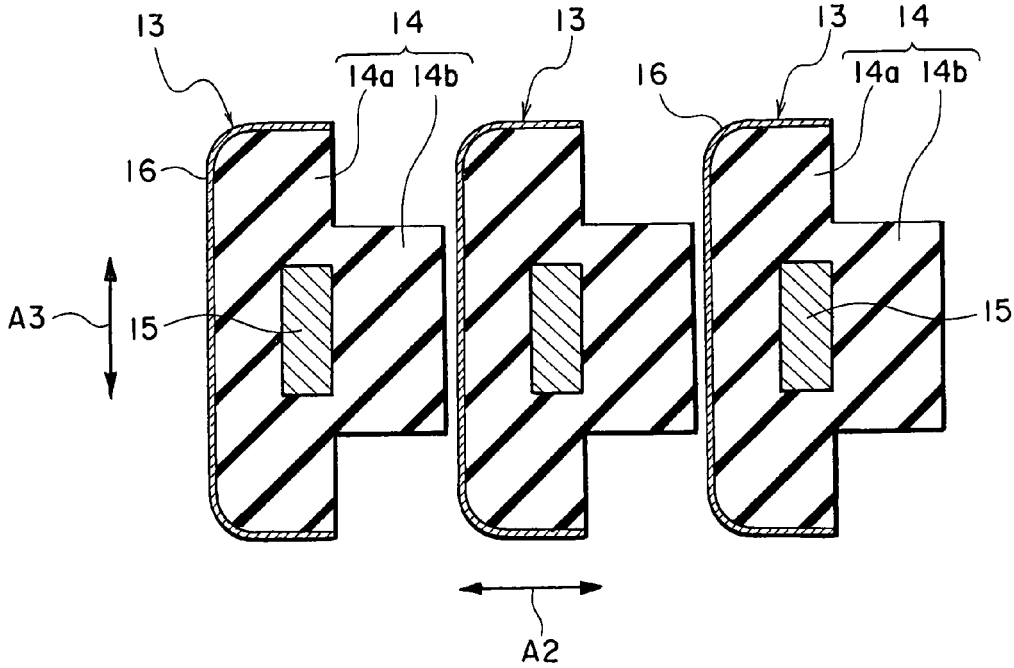
FIG. 3 is an enlarged sectional view, taken along a line III-III in FIG. 1, showing connecting members used in the connection apparatus illustrated in FIG. 1.

Referring to FIGS. 1 to 3, description will be made of a connection apparatus according to a first embodiment of this invention.

The connection apparatus 10 in FIG. 1 is adapted to electrically connect two connection objects and comprises a frame 11 in FIG. 2 having a thin plate-like shape and adapted to be disposed between the connection objects. The frame 11 is provided with a large number of connection member receiving portions 12 as shown in FIG. 3. The connection member receiving portions 12 are arranged in three rows adjacent to one another in a first direction A1. In a second direction A2 perpendicular to the first direction A1, a number of the connection member receiving portions 12 are arranged adjacent to one another in each row.

Each of the connection member receiving portions 12 penetrates the frame 11 between its upper and lower surfaces 11*a* and 11*b*, i.e., in a third direction A3 perpendicular to the first and the second directions A1 and A2. In the connection member receiving portions 12, a number of connection members 13 in FIG. 3 are disposed, respectively.

Each of the connection members 13 comprises an elastic member 14 of a generally T-shaped section having two end portions protruding from the upper and the lower surfaces 11*a* and 11*b* of the frame 11, respectively. The elastic member 14 comprises a main body 14*a* extending long in the first direction A1 and having a flattened U-shaped section with rounded corners on one side in the second direction A2, and a pitch interval portion or an auxiliary portion 14*b* having a rectangular section formed on the other side of the main body 14*a* in the second direction A2. The main body 14*a* and the auxiliary portion 14*b* are integrally formed from a flexible material, such as rubber, having a generally T-shaped section.

Inside the main body 14*a*, a core member or a stiffener member 15 higher in rigidity than the elastic member 14 is disposed to penetrate the main body 14*a* in the first direction A1. On the one side of the main body 14*a*, a plurality of electrodes (conductors) 16 comprising strip-like conductive films are disposed to cover opposite end surfaces and one side surface of the main body 14*a*. The electrodes 16 are formed at a predetermined pitch in the first direction A1. Each of the electrodes 16 may be formed by electroless plating, by adhering a conductive thin film, such as a metal foil, to the main body 14*a*, or by applying a conductive paint or a conductive paste to the main body 14*a*. Thus, the electrodes (conductors) 16 are formed on a surface of the elastic member 14 to extend between the two end portions thereof.

The stiffener member 15 is longer than the connecting member 13 and penetrates the connecting member 13 with its opposite ends exposed as protruding portions 15*a*. On the other hand, on the upper surface 11*a* of the frame 11, a number of stiffener grooves 17 as engaging portions are formed to extend in the first direction A1 in correspondence to the connecting member receiving portions 12. The protruding portions 15*a* of each stiffener member 15 are inserted into the stiffener grooves 17 to be engaged with the frame 11. As a consequence, the connecting members 13 are received in the connecting member receiving portions 12 and supported by the frame 11 in an array. Thus, each of the elastic members 14 is positioned with respect to the frame 11 by means of the stiffener member 15 as a separate member. In other words, the stiffener member 15 serves as a positioning member.

With the above-mentioned structure, when the connecting member 13 is received in the connection member receiving portion 12 and supported by the frame 11, it is unnecessary to press-fit the protruding portions 15*a* of the stiffener member 15 into the stiffener grooves 17. Therefore, it is possible to improve assemblability of the connection apparatus 10.

In the illustrated example, the main body 14*a* of the elastic member 14 is formed to have a flattened U-shaped section throughout its entire length. Alternatively, each of those portions corresponding to areas between every adjacent ones of the electrodes 16 is provided with upper and lower grooves so that the portion has a rectangular section. In this case, only the remaining portions of the main body 14*a* corresponding to the electrodes 16 have a flattened U-shaped section.

Figure 4:
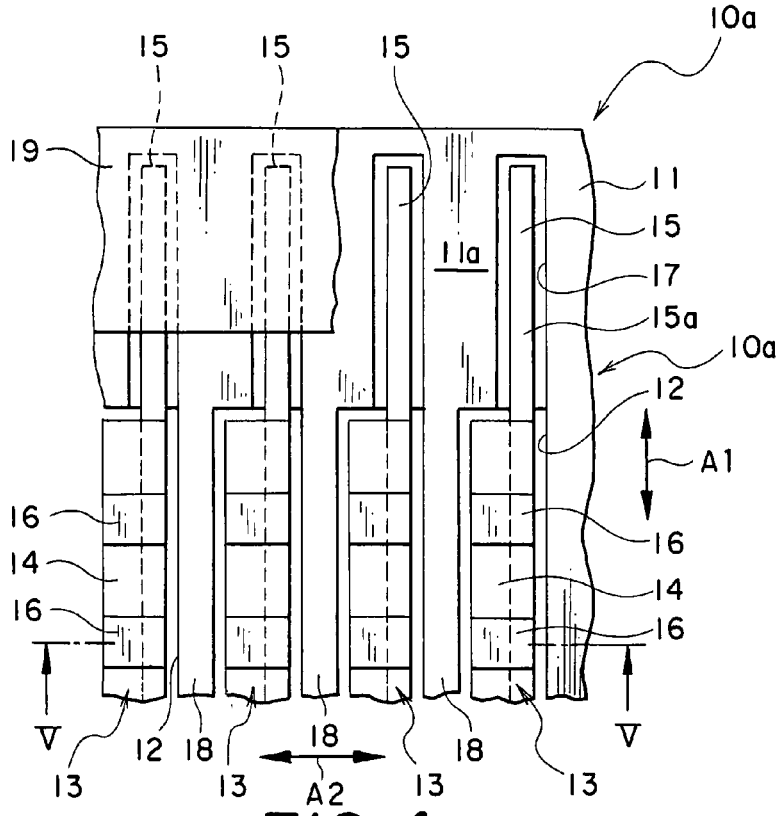
FIG. 4 is a plan view of a characteristic part of a connection apparatus according to a second embodiment of this invention.
Figure 5:
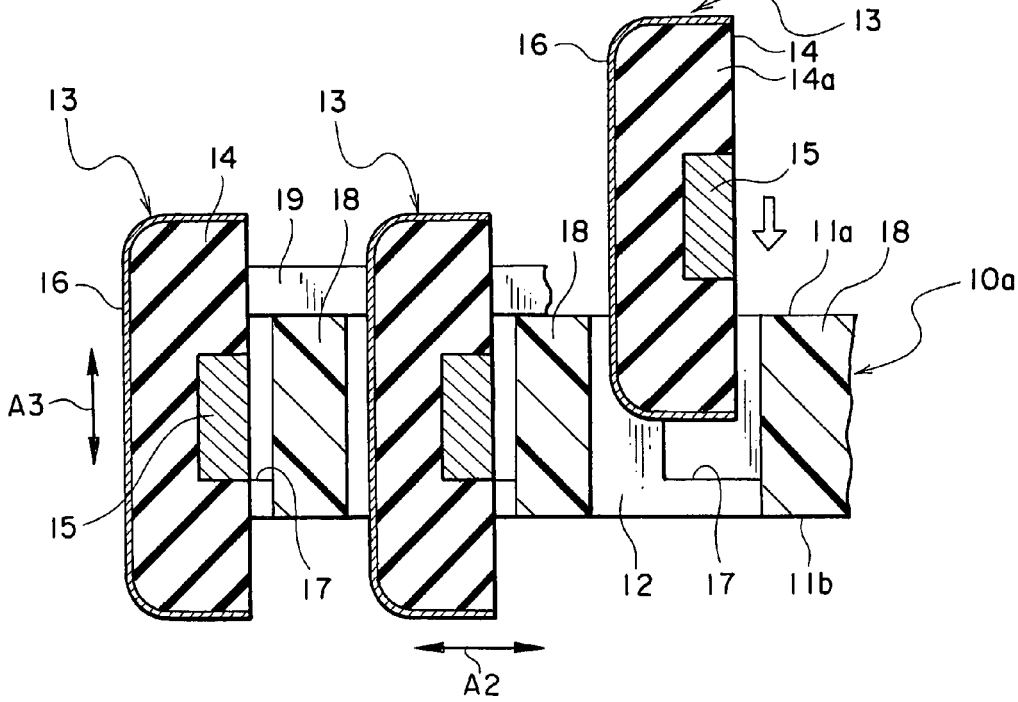
FIG. 5 is an enlarged sectional view taken along a line V-V in FIG. 4.

Referring to FIGS. 4 and 5, description will be made of a connection apparatus according to a second embodiment of this invention. Those parts having similar functions are designated by like reference numerals and description thereof will be omitted. In FIG. 5, only a most right one of the connection members 13 is being received in a predetermined position of the connection member receiving portion 12.

In the connection apparatus 10*a* illustrated in FIGS. 4 and 5, the elastic member 14 comprises the main body 14*a* alone without the auxiliary portion 14*b* illustrated in FIGS. 2 and 3. Between every adjacent ones of the stiffener grooves 17, a plurality of bars 18 of the frame 11 are formed to define the connection member receiving portions 12. Thus, in order to prevent short-circuiting of the electrodes 16 adjacent to one another in the second direction A2, the bars 13 of the frame 11 are interposed between the connection members 13. Accordingly, the connection members 13 can be arranged at a high density.

After the protruding portions 15*a* of the stiffener members 15 are inserted into the stiffener grooves 17 of the frame 11, a cap member 19 is disposed on the upper surface 11*a* of the frame 11. The cap member 19 is fixed to the frame 11 by screws or the like (not shown). Thus, the cap member 19 at least partially covers the stiffener grooves 17 to prevent the protruding portions 15*a* of the stiffener members 15 from being released and displaced. Accordingly, the electrodes 16 of the connection members 13 are held at equal intervals.

It will readily be understood that, like the connection apparatus 10 described in conjunction with FIGS. 1 to 3, the connection apparatus 10*a* may be modified in various manners.

Figure 6:
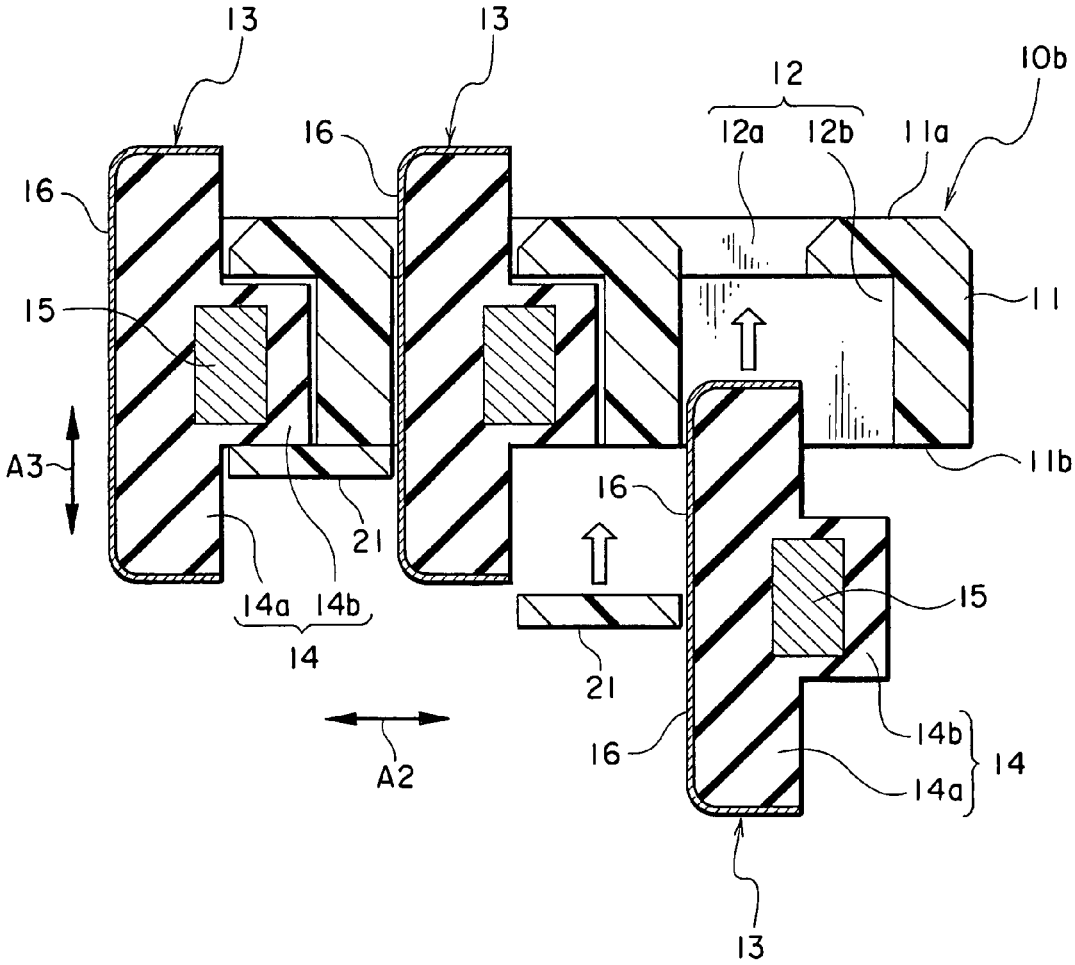
FIG. 6 is a sectional view, similar to FIG. 5, showing a connection apparatus according to a third embodiment of this invention.

Referring to FIG. 6, description will be made of a connection apparatus according to a third embodiment of this invention. Those parts having similar functions are designated by like reference numerals and description thereof will be omitted. In FIG. 6, it should be noted that a most right one of the connection members 13 is being received in a predetermined position of the connection member receiving portion 12 and that a middle one of the connection members 13 is not fixed to the frame 11 although it is received in the predetermined position.

In the connection apparatus 10*b* illustrated in FIG. 6, each connection member receiving portion 12 has a vertical through hole 12*a* opened on the upper and the lower surfaces 11*a* and 11*b* of the frame 11, and a horizontal hole 12*b* adjacent to the through hole 12*a*. The horizontal hole 12*b* is opened only on the lower surface 11*b* of the frame 11. The stiffener member 15 is disposed at a boundary between the main body 14*a* and the auxiliary portion 14*b* of the elastic member 14.

Each connection member 13 is fitted to each connection member receiving portion 12 from the lower surface 11*b* of the frame 11. At this time, the main body 14*a* of the elastic member 14 is disposed in the through hole 12*a* while the auxiliary portion 14*b* of the elastic member 14 is disposed in the horizontal hole 12*b*. Thereafter, an adhesive tape 21 is adhered to the lower surface 11*b* of the frame 11 to close a lower opening of the horizontal hole 12*b* by the adhesive tape 21. As a consequence, the adhesive tape 21 covers the horizontal hole 12*b* to support the auxiliary portion 14*b* of the elastic member 14. Thus, the elastic member 14 is positioned with respect to the frame 11 by the adhesive tape 21 as a separate member. In other words, the adhesive tape 21 serves as a positioning member.

It will readily be understood that, like the connection apparatus 10 described in conjunction with FIGS. 1 to 3, the connection apparatus 10*b* may be modified in various manners.

Figure 7:
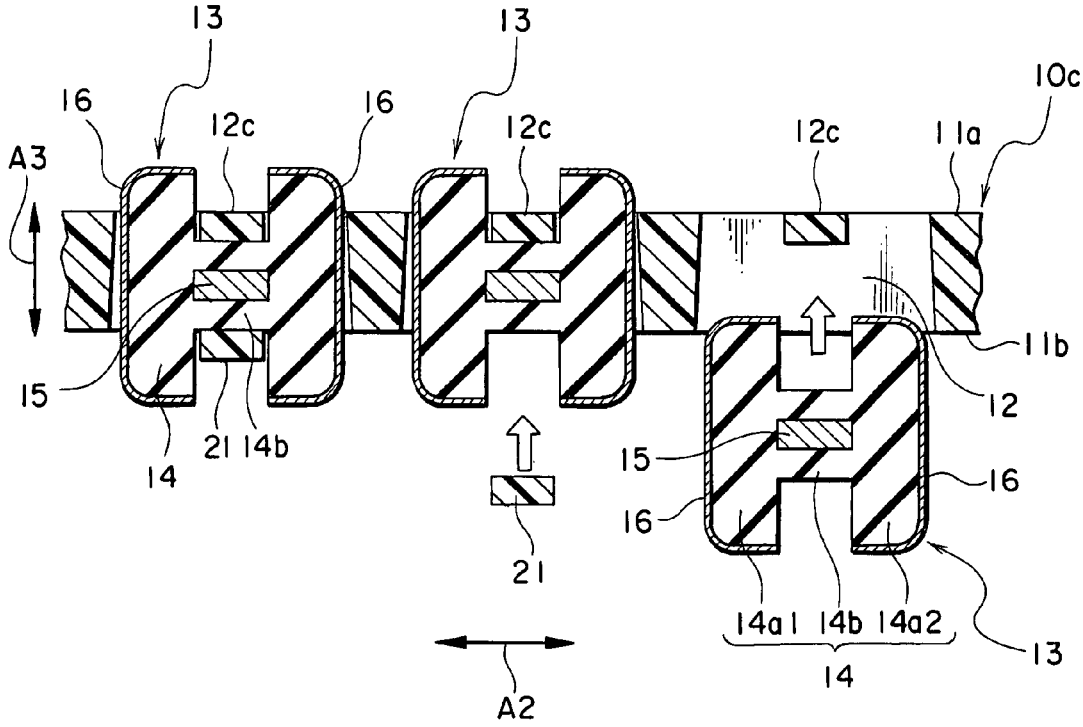
FIG. 7 is a sectional view, similar to FIG. 5, showing a connection apparatus according to a fourth embodiment of this invention.

Referring to FIG. 7, description will be made of a connection apparatus according to a fourth embodiment of this invention. Those parts having similar functions are designated by like reference numerals and description thereof will be omitted. In FIG. 7, it should be noted that a most right one of the connection members 13 is being received in a predetermined position of the connection member receiving portion 12 and that a middle one of the connection members 13 is not fixed to the frame 11 although it is received in the predetermined position.

In the connection apparatus 10*c* illustrated in FIG. 7, the elastic member 14 has first and second main bodies 14*a*1 and 14*a*2 parallel to each other with a space left therebetween. The auxiliary portion 14*b* of the elastic member 14 is formed between the first and the second main bodies 14*a*1 and 14*a*2 and connects the first and the second main bodies 14*a*1 and 14*a*2. Therefore, the elastic member 14 has a generally H-shaped section. The stiffener member 15 is disposed in the auxiliary portion 14*b* of the elastic member 14. Each connection member receiving portion 12 is provided with a partitioning portion or a locking bridge 12*c* formed at the center of its upper part.

Each connection member 13 is fitted to each connection member receiving portion 12 from the lower surface 11*b* of the frame 11. At this time, the locking bridge 12 is inserted between upper parts of the first and the second main bodies 14*a*1 and 14*a*2 of the elastic member 14. Thereafter, the adhesive tape 21 is inserted between lower parts of the first and the second main bodies 14*a*1 and 14*a*2 of the elastic member 14 and adhered to the lower surface 11*b* of the frame 11. As a consequence, the adhesive tape 21 supports the auxiliary portion 14*b* of the elastic member 14. Thus, the elastic member 14 is positioned with respect to the frame 11 by the adhesive tape 21 as a separate member. In other words, the adhesive tape 21 serves as a positioning member.

It will readily be understood that, like the connection apparatus 10 described in conjunction with FIGS. 1 to 3, the connection apparatus 10*b* may be modified in various manners.

Figure 8:
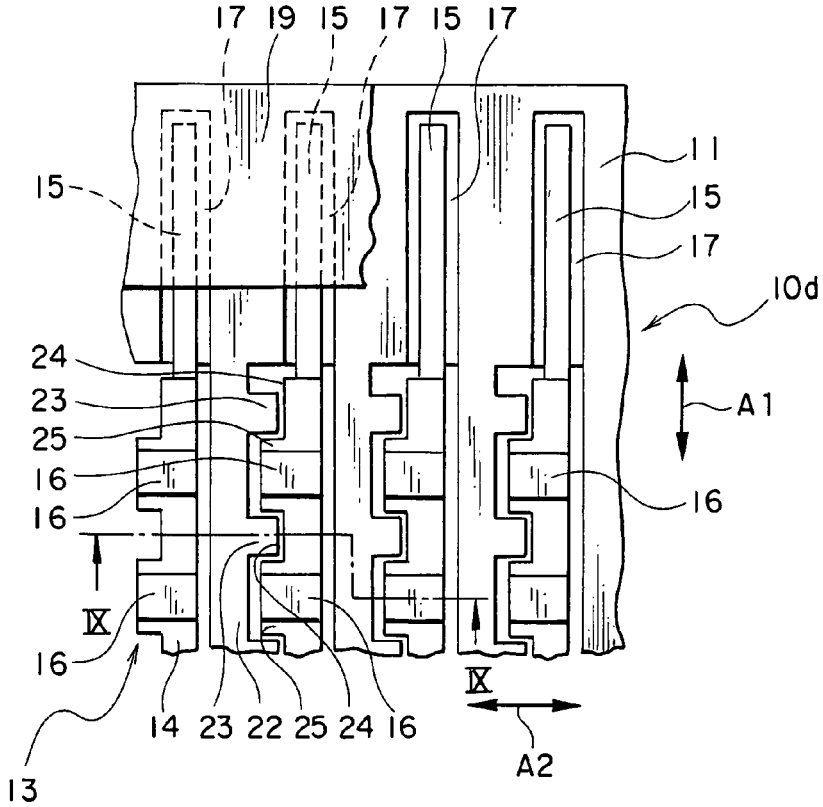
FIG. 8 is a plan view of a characteristic part of a connection apparatus according to a fifth embodiment of this invention.
Figure 9:
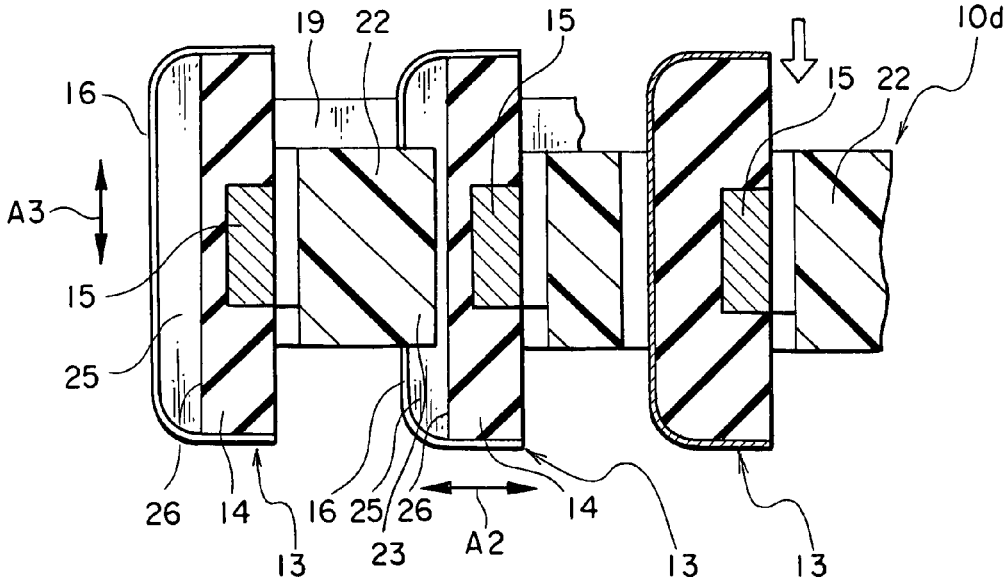
FIG. 9 is an enlarged sectional view taken along a line IX-IX in FIG. 8.

Referring to FIGS. 8 and 9, description will be made of a connection apparatus according to a fifth embodiment of this invention. Those parts having similar functions are designated by like reference numerals and description thereof will be omitted.

The connection apparatus 10*d* illustrated in FIGS. 8 and 9 comprises a positioning member 22 integrally formed with the frame 11 and extending in the first direction A1. The positioning member 22 has a plurality of protrusions 23 protruding on one side in the second direction A2. The protrusions 23 are spaced from one another in the first direction A1. On the other hand, the elastic member 14 has a convexo-concave shape with a plurality of recesses 24 engaged with the protrusions 23, respectively, and a plurality of connecting portions 25 adjacent to the recesses 24 in the first direction A1. In other words, the elastic member 14 has a rectangular cylindrical main body 26 extending long in the first direction A1, and the connecting portions 25 protruding from the main body 26 with a space left from one another in the first direction A1. The recesses 24 are defined between every adjacent ones of the connecting portions 25. The conductors 16 are disposed on surfaces of the connecting portions 25.

The stiffener member 15 higher in rigidity than the elastic member 14 is coupled with the elastic member 14. The stiffener member 15 protrudes from the elastic member 14 in the first direction A1 to be engaged with the stiffener grooves 17 of the frame 11. As a consequence, the connection members 13 are received in the connection member receiving portions 12 and supported by the frame 11 in an array. Thus, the elastic member 14 is positioned with respect to the frame 11 by the stiffener member 15 as a separate member. In other words, the stiffener member 15 serves as a positioning member. The recesses 24 of the elastic members 14 are fitted over the protrusions 23 of the positioning member 22 extending in the first direction A1 so that the elastic member 14 is positioned in the first direction A1. Accordingly, the connecting member 13 can easily and accurately be positioned.

Figure 10A:
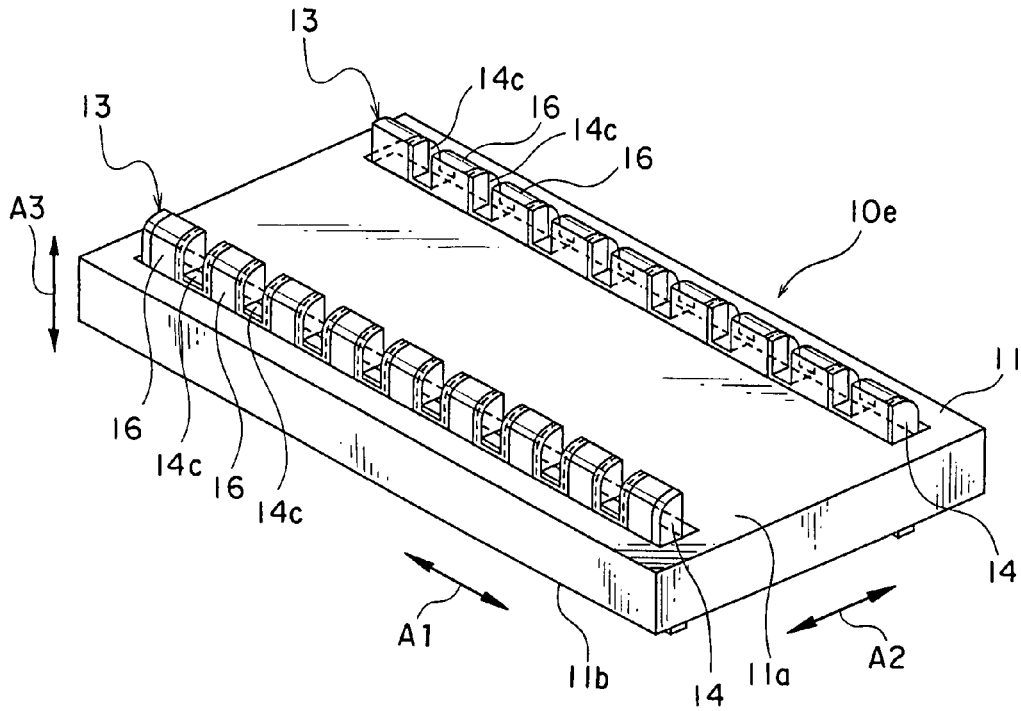
FIG. 10A is a perspective view of a connection apparatus according to a sixth embodiment of this invention.
Figure 10B:
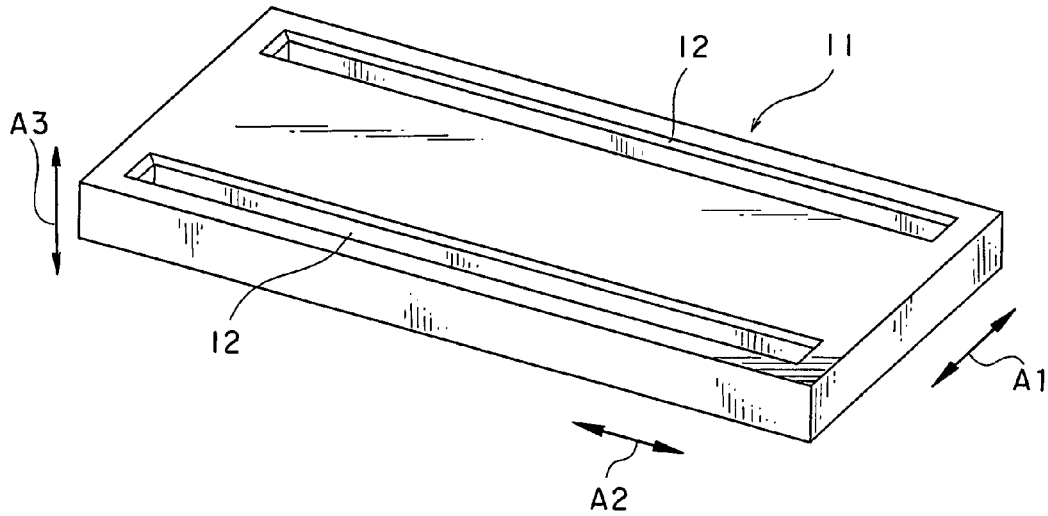
FIG. 10B is a perspective view of a frame used in the connection apparatus illustrated in FIG. 10A.

Referring to FIGS. 10A and 10B, description will be made of a connection apparatus according to a sixth embodiment of this invention. Those parts having similar functions are designated by like reference numerals and description thereof will be omitted.

In the connection apparatus 10*e* illustrated in FIG. 10A, the frame 11 has two connecting member receiving portions 12 spaced from each other in the second direction A2 as illustrated in FIG. 10B. Each of the connecting member receiving portions 12 extends long in the first direction A1. The connecting members 13 are received in the connecting member receiving portions 12, respectively. Therefore, the connecting members 13 are equal in number to two and are spaced from each other in the second direction A2.

The elastic member 14 of each connecting member 13 is provided with a plurality of electrodes (conductors) 16 comprising strip-like conductive films and covering one side surface thereof. The electrodes 16 are formed at a predetermined pitch in the first direction A1. The elastic member 14 has end portions protruding from the opposite surfaces 11*a* and 11*b* of the frame 11 and provided with a number of cuts or grooves 14*c* corresponding to areas between every adjacent ones of the electrodes 16.

Like the connection apparatuses 10 to 10*d* described in conjunction with FIGS. 1 to 9, the connecting member 13 is positioned with respect to the frame 11 by a member separate from the connecting member 13.

Figure 11:
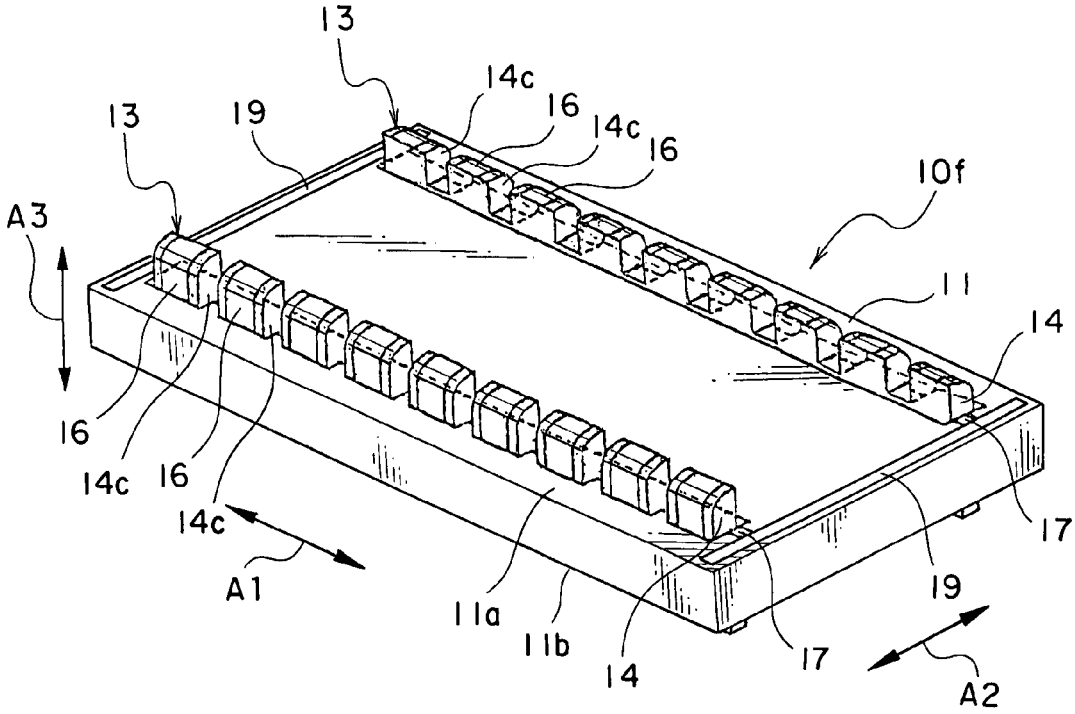
FIG. 11 is a perspective view of a connection apparatus according to a seventh embodiment of this invention.

Referring to FIG. 11, description will be made of a connection apparatus according to a seventh embodiment of this invention. Those parts having similar functions are designated by like reference numerals and description thereof will be omitted.

In the connection apparatus 10*f* illustrated in FIG. 11, the elastic member 14 has end portions protruding from the opposite surfaces 11*a* and 11*b* of the frame 11 and provided with a number of cuts or grooves 14*c* corresponding to areas between every adjacent ones of the electrodes 16, like in the connection apparatus 10*e* illustrated in FIG. 10A.

Like in the connection apparatus 10*a* illustrated in FIG. 4, each of the connection members 13 includes a stiffener member (not shown) formed as a member separate from the elastic member 14 and fixed to the elastic member 14. The stiffener member has end portions corresponding to the protruding portions 15 of the connection apparatus 10*a* illustrated in FIG. 4. The end portions of the stiffener member are inserted into stiffener grooves 17 of the frame 11. After that, the cap members 19 are disposed on the upper surface 11*a* of the frame 11. By screws or the like (not shown), the cap members 19 are fixed to the frame 11. Thus, each of the cap members 19 at least partially covers each of the stiffener grooves 17 to prevent the end portions of the stiffener member 15 from being released and displaced. Accordingly, the electrodes 16 of the connection members 13 are held at equal intervals.

Figure 12A:
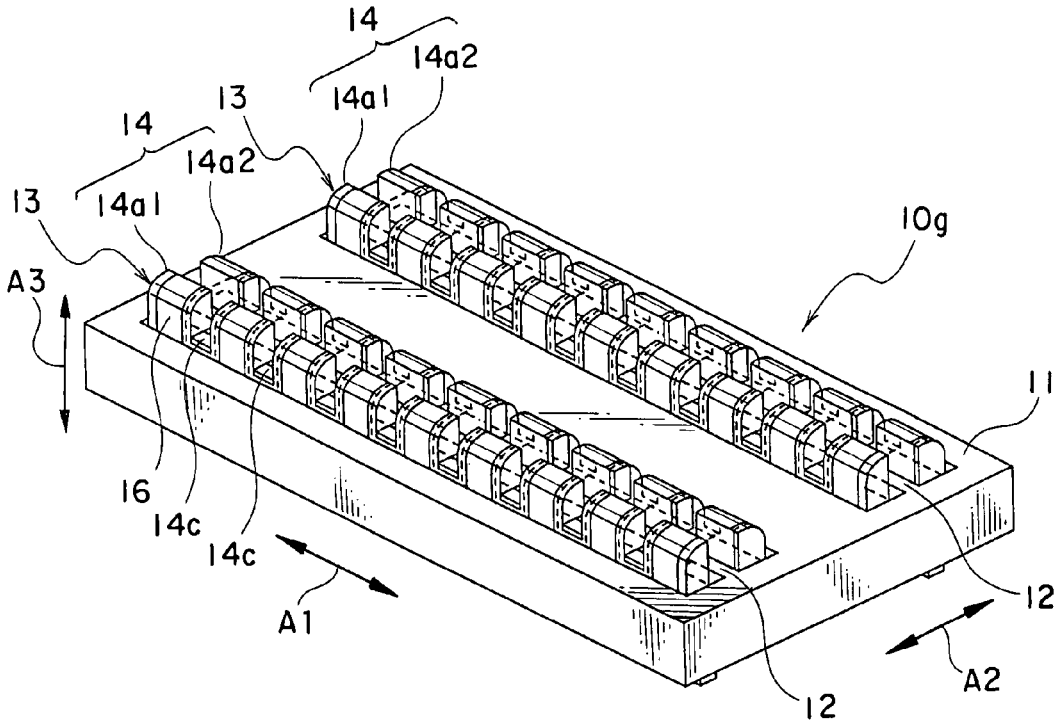
FIG. 12A is a perspective view of a connection apparatus according to an eighth embodiment of this invention.
Figure 12B:
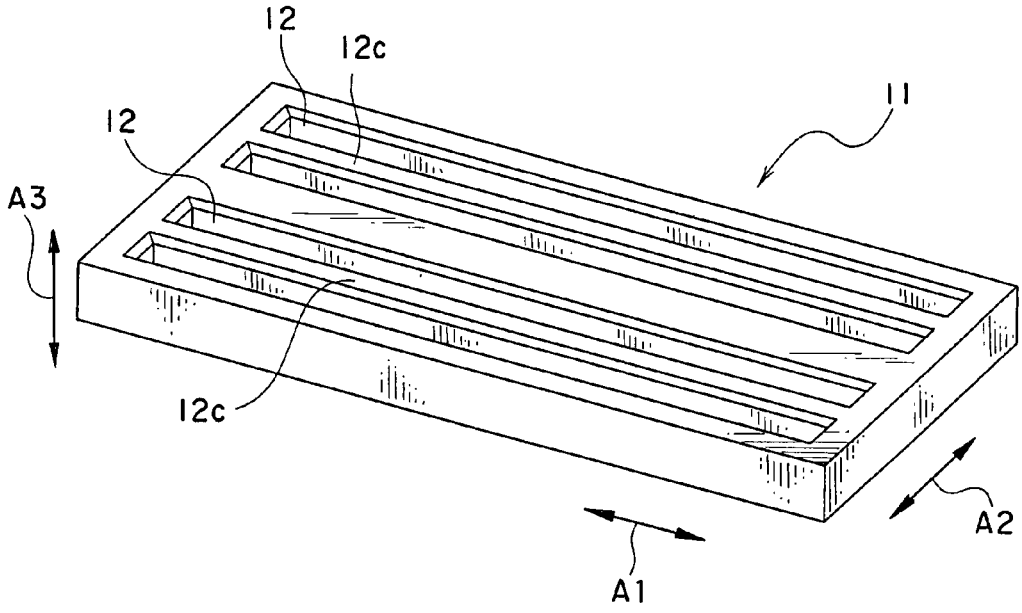
FIG. 12B is a perspective view of a frame used in the connection apparatus illustrated in FIG. 12A.

Referring to FIGS. 12A and 12B, description will be made of a connection apparatus according to an eighth embodiment of this invention. Those parts having similar functions are designated by like reference numerals and description thereof will be omitted.

In the connection apparatus 10*g* illustrated in FIG. 12A, the frame 11 has two connecting member receiving portions 12 spaced from each other in the second direction A2 as illustrated in FIG. 12B. Each of the connecting member receiving portions 12 is provided with the partitioning member or the locking bridge 12*c* formed at the center of its upper part. Each connecting member receiving portion 12 extends long in the first direction A1. The connecting members 13 are received in the connecting member receiving portions 12, respectively. Therefore, the connecting members 13 are equal in number to two and are spaced from each other in the second direction A2.

The elastic member 14 of each connecting member 13 has the first and the second main bodies 14*a*1 and 14*a*2 parallel to each other with a space left therebetween. The first and the second main bodies 14*a*1 and 14*a*2 are connected to each other by the auxiliary portion (not shown), like the connecting apparatus 10*c* illustrated in FIG. 7. Therefore, the elastic member 14 has a generally H-shaped section.

Each connecting member 13 is provided with a plurality of electrodes (conductors) 16 comprising strip-like conductive films and covering one side surface of the elastic member 14. The electrodes 16 are formed at a predetermined pitch in the first direction A1. The elastic member 14 has the end portions protruding from the opposite surfaces 11*a* and 11*b* of the frame 11 and provided with a number of the cuts or grooves 14*c* corresponding to the areas between every adjacent ones of the electrodes 16.

Each connection member 13 is fitted to each connection member receiving portion 12 from the lower surface 11*b* of the frame 11. At this time, the locking bridge 12*c* is inserted between the upper parts of the first and the second main bodies 14*a*1 and 14*a*2 of the elastic member 14. Thereafter, like the connection apparatus 10*c* in FIG. 7, the adhesive tape 21 is inserted between the lower parts of the first and the second main bodies 14*a*1 and 14*a*2 of the elastic member 14 and adhered to the lower surface 11*b* of the frame 11. As a consequence, the adhesive tape 21 supports the auxiliary portion of the elastic member 14. Thus, the elastic member 14 is positioned with respect to the frame 11 by the adhesive tape 21 as a separate member.

Figure 13A:
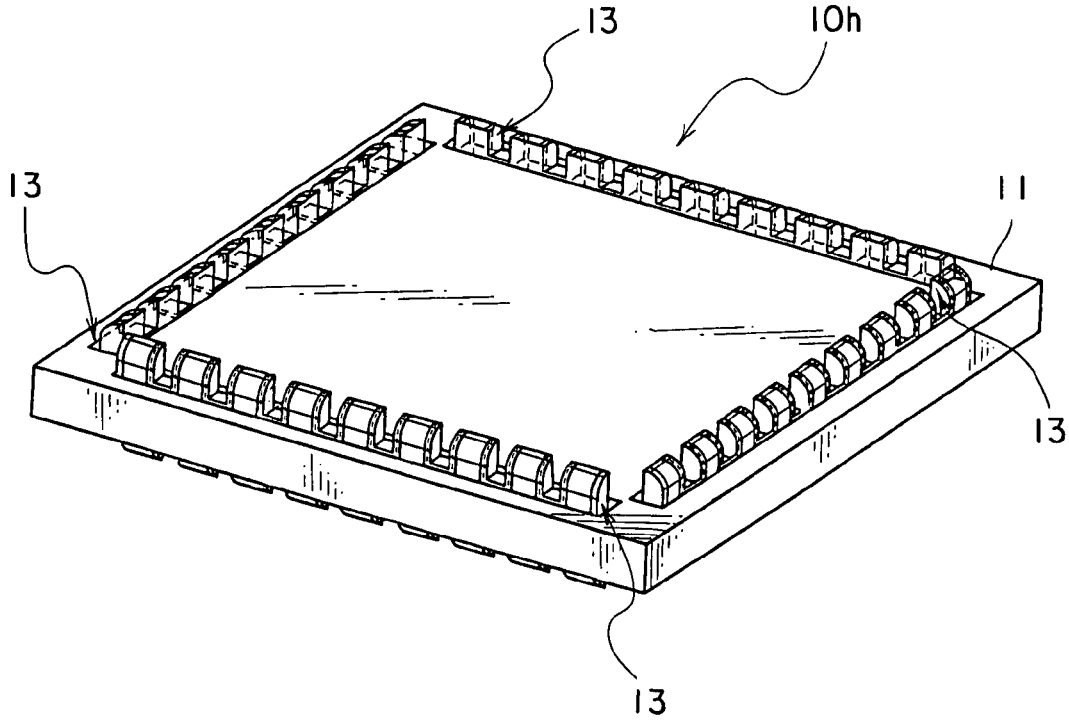
FIG. 13A is a perspective view of a connection apparatus according to a ninth embodiment of this invention.
Figure 13B:
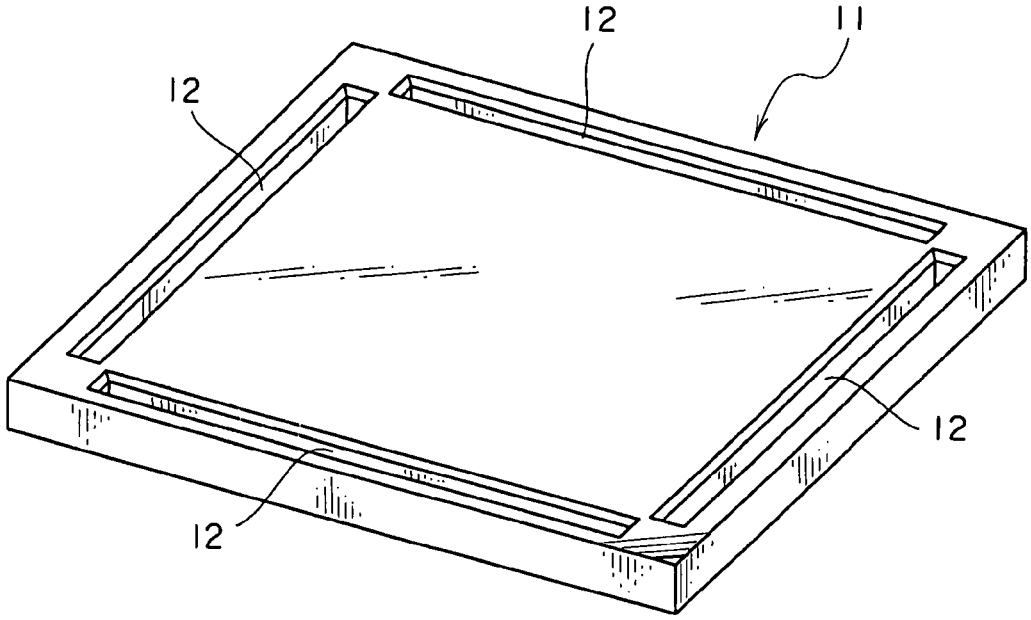
FIG. 13B is a perspective view of a frame used in the connection apparatus illustrated in FIG. 13A.

Referring to FIGS. 13A and 13B, description will be made of a connection apparatus according to a ninth embodiment of this invention. Those parts having similar functions are designated by like reference numerals and description thereof will be omitted.

The connection apparatus 10*h* in FIG. 13A is substantially similar to the connection apparatus 10*f* illustrated in FIG. 10A or 11 except that the frame 11 has an appearance of a generally square plate and that the connecting members 13 are mounted along four sides of the frame 11. Like the connection apparatuses 10 to 10*d* described in conjunction with FIGS. 1 to 9, the connecting member 13 is positioned with respect to the frame 11 by a member separate from the connecting member 13.

Figure 14:
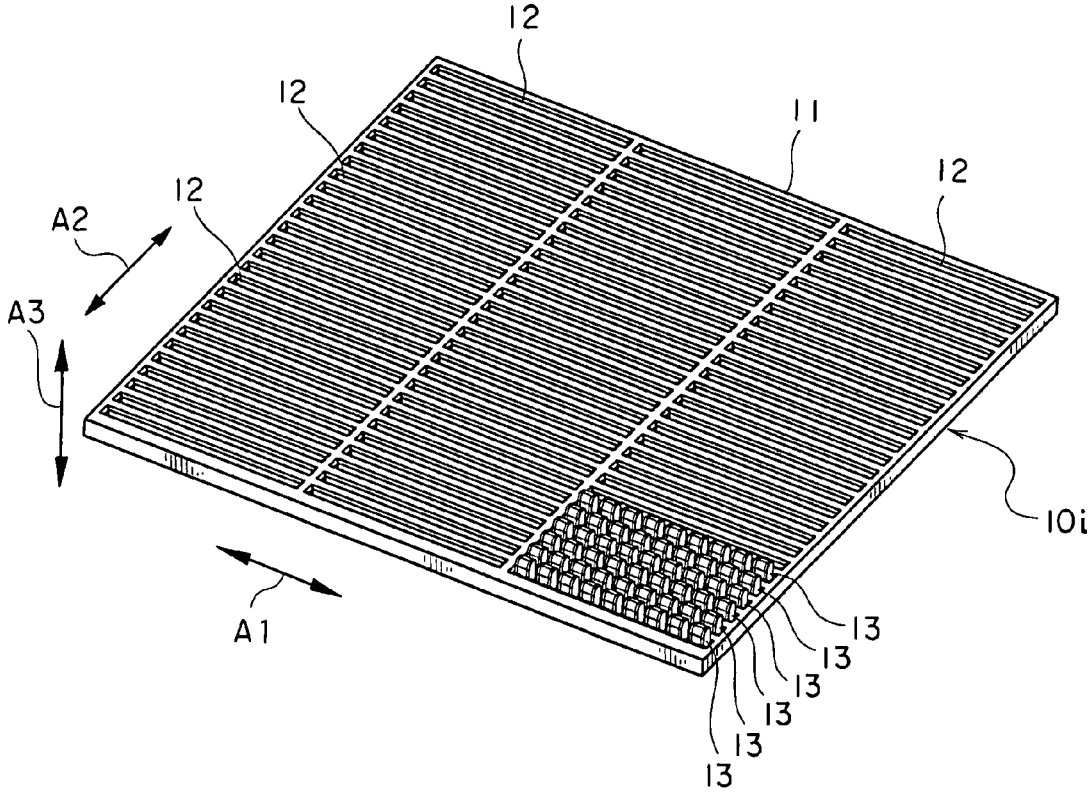
FIG. 14 is a perspective view for describing a connection apparatus according to a tenth embodiment of this invention.

Referring to FIG. 14, description will be made of a connection apparatus according to a tenth embodiment of this invention. Those parts having similar functions are designated by like reference numerals and description thereof will be omitted. For convenience of illustration, the connecting members 13 are disposed only in some of the connecting member receiving portions 12.

The frame 11 of the connection apparatus 10*i* in FIG. 14 is substantially similar to the frame 11 of the connection apparatus 10 described in conjunction with FIGS. 1 to 3. The connecting members 13 are disposed in a number of connecting member receiving portions 12 of the frame 11. Each connecting member 13 is substantially similar to the connecting member 13 of the connection apparatus 10*e* illustrated in FIG. 10A. Therefore, like the connection apparatuses 10 to 10*d* described in conjunction with FIGS. 1 to 9, the connecting member 13 is positioned with respect to the frame 11 by a member separate from the connecting member 13.

Figure 15:
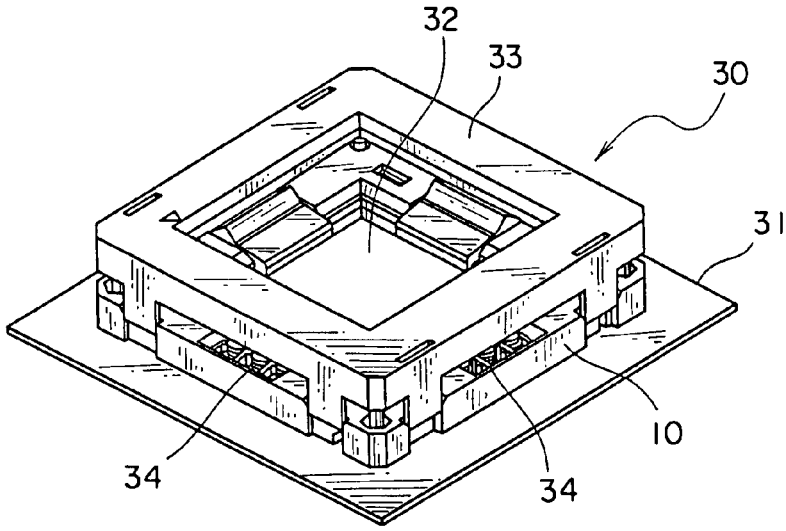
FIG. 15 is a perspective view of a mounting apparatus, for describing an example of use of the connection apparatus.

Referring to FIG. 15, description will be made of a mounting apparatus 30 for mounting a semiconductor chip 32 to a circuit board 31 by the use of the above-mentioned connection apparatus 10.

In FIG. 15, the connection apparatus 10 is disposed on the circuit board 31. On the connection apparatus 10, the semiconductor chip 32 is disposed. By a pressing device 33 fixed to the circuit board 31, the semiconductor chip 32 is pressed against the connecting apparatus 10. The semiconductor chip 32 is pressed and held by springs 34.

By the use of any one of the connection apparatuses 10*a* to 10*i*, the semiconductor chip 32 can electrically and mechanically connected to the circuit board 31 by the use of the mounting apparatus 30.

While the present invention has thus far been described in connection with a few embodiments thereof, it will readily be possible for those skilled in the art to put this invention into practice in various other manners. For example, the stiffening member 15 may be formed inside the elastic member by integral molding or may be inserted through a through hole preliminarily formed in the elastic member.

What is claimed is:

1. A connection apparatus for electrically connecting two connection objects to each other, the connection apparatus comprising:

a frame disposed between the connection objects and having two surfaces faced to the connection objects, respectively;

an elastic member penetrating the frame and having two end portions protruding from the two surfaces, respectively;

a conductor coupled with the elastic member and extending between the two end portions; and a positioning member formed as a member separate from the elastic member and positioning the elastic member with respect to the frame;

the positioning member being integrally formed with the frame and extending in a first direction parallel to the surfaces;

the positioning member having a protrusion protruding in a second direction parallel to the surfaces and perpendicular to the first direction;

the elastic member having a recess engaged with the protrusion and positioned by the positioning member in the first direction.

2. The connection apparatus according to claim 1, wherein the elastic member has a connecting portion adjacent to the recess in the first direction, the conductor being disposed on a surface of the connecting portion.

3. The connection apparatus according to claim 1, wherein the elastic member has a rectangular cylindrical main body extending long in the first direction, and a plurality of connecting portions protruding from the main body with a space left from one another in the first direction, the recess being defined between every adjacent ones of the connecting portions, the conductor being disposed on a surface of each connecting portion.

4. The connection apparatus according to claim 1, further comprising a stiffener member higher in rigidity than the elastic member and extending inside the elastic member in the first direction.

5. The connection apparatus according to claim 4, wherein the stiffener member has a protruding portion protruding from the elastic member in the first direction and engaged with the frame.

* * * * *